US008960460B2

(12) United States Patent
Mentink et al.

(10) Patent No.: US 8,960,460 B2
(45) Date of Patent: Feb. 24, 2015

(54) COUNTERWEIGHT BLOCK AND ASSEMBLIES FOR CRANES

(75) Inventors: Trevor D. Mentink, Oostburg, WI (US); William J. O'Neil, Green Bay, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 759 days.

(21) Appl. No.: 12/718,156

(22) Filed: Mar. 5, 2010

(65) Prior Publication Data

US 2010/0224583 A1 Sep. 9, 2010

Related U.S. Application Data

(60) Provisional application No. 61/158,599, filed on Mar. 9, 2009.

(51) Int. Cl.
*B66C 23/76* (2006.01)
*B66C 23/74* (2006.01)

(52) U.S. Cl.
CPC ..... *B66C 23/76* (2013.01); *B66C 23/74* (2013.01)
USPC ..... 212/197; 212/195; 280/759

(58) Field of Classification Search
CPC .. B62D 49/08; B62D 49/085; B62D 49/0628; B62D 49/0607; B62D 49/0621; B62D 37/04; B66C 23/26; B66C 23/72; B66C 23/74; B66C 23/76; B66C 23/53; B66C 2700/0314; B66C 2700/0392; E02F 9/18; B66B 17/12; E01B 27/04; E01B 27/02; E01B 27/00; E01B 27/023; E01B 27/06
USPC ..... 212/175, 178, 195–198, 308; 187/405; 280/187, 757, 758, 759; 414/637, 719
See application file for complete search history.

(56) References Cited

U.S. PATENT DOCUMENTS 4,902,038 A 2/1990 Grover
4,971,356 A 11/1990 Cook
(Continued)

FOREIGN PATENT DOCUMENTS

CA 2618457 A1 * 7/2008
CN 101309850 A 11/2008
(Continued)

OTHER PUBLICATIONS

Extended European Search Report, EP Application No. 10250425.5, dated Apr. 26, 2011 (9 pages).
(Continued)

*Primary Examiner* — Sang Kim
*Assistant Examiner* — Nathaniel Adams
(74) *Attorney, Agent, or Firm* — Craig Buschmann; Brinks Gilson & Lione

(57) ABSTRACT

A counterweight block apparatus includes a pair of interconnecting counterweight blocks having top and bottom surfaces, the counterweight blocks forming a plane of interconnection along adjacent sides thereof; and a shear bar releasably secured between the adjacent sides of the interconnecting counterweight blocks, generally perpendicular to the plane of interconnection, to provide resistance to relative vertical movement of the interconnecting counterweight blocks along the plane of interconnection. In another aspect, each counterweight block includes in at least one side thereof an indentation from a top of the counterweight block to a depth more shallow than the thickness of the counterweight block, the indentation defining a lip for hand grabbing. An aperture may be formed through the rest of the thickness of the counterweigh block at each indentation, wherein a securing strap can be run through each aperture of a stacked plurality of counterweight blocks to secure them to each other.

10 Claims, 8 Drawing Sheets

(56) References Cited

U.S. PATENT DOCUMENTS

| | | | | |
|---|---|---|---|---|
| 5,462,309 | A * | 10/1995 | Jeffers et al. | 280/759 |
| 5,598,935 | A | 2/1997 | Harrison et al. | |
| 5,615,784 | A * | 4/1997 | Pech et al. | 212/178 |
| 6,079,741 | A * | 6/2000 | Maver | 280/759 |
| 6,209,898 | B1 * | 4/2001 | Fortier et al. | 280/187 |
| 6,315,325 | B1 | 11/2001 | Dunn | |
| 6,575,679 | B2 * | 6/2003 | Bourgault et al. | 410/90 |
| 2005/0284834 | A1 * | 12/2005 | Willim | 212/178 |
| 2008/0197615 | A1 | 8/2008 | Connolly | |
| 2008/0246262 | A1 | 10/2008 | Adams et al. | |
| 2008/0253875 | A1 * | 10/2008 | Yamamoto et al. | 414/719 |
| 2009/0272708 | A1 * | 11/2009 | Zollondz et al. | 212/196 |

FOREIGN PATENT DOCUMENTS

| | | | |
|---|---|---|---|
| CN | 102229414 | | 11/2011 |
| DE | 3943324 | | 7/1990 |
| DE | 20003490 | | 2/2000 |
| DE | 20019287 | | 3/2002 |
| DE | 20 2005 016815 | U1 | 3/2007 |
| DE | 102006010488 | A1 * | 5/2007 |
| EP | 1 205 422 | B1 | 10/2004 |
| EP | 2436639 | | 4/2012 |
| FR | 2 897 050 | A1 | 8/2007 |
| GB | 190614267 | | 4/1907 |
| JP | U 1984-136385 | | 9/1984 |
| JP | 1999-165985 | A | 6/1999 |
| JP | 2000143165 | | 5/2000 |
| JP | 2001261286 | | 9/2001 |
| JP | 2002 284484 | A | 10/2002 |

OTHER PUBLICATIONS

Search Report of corresponding EP Application No. 12192257.9 dated Jan. 2, 2013, 5 pages.

Office Action from corresponding CN Application No. 201010176778.X, dated Jul. 19, 2013 (22 pages).

European Search Report from corresponding EP Application No. 12184080.5, dated Dec. 6, 2012 (4 pages).

European Search Report from corresponding EP Application No. 12192250.4, dated Jan. 14, 2013 (4 pages).

JP Office Action dated Apr. 1, 2014, for related JP Application No. 2010-051457, filed Mar. 9, 2010, with associated English translation.

* cited by examiner 124
164
104
125
124
104
84
34
125
125
100
100
100
100
158
120
154
125
100
100
100
100

COUNTERWEIGHT BLOCK AND ASSEMBLIES FOR CRANES

REFERENCE TO EARLIER FILED APPLICATION

This application claims the benefit under 35 U.S.C. §119 (e) of U.S. Provisional Patent Application No. 61/158,599, filed Mar. 9, 2009, and titled "COUNTERWEIGHT BLOCK AND ASSEMBLIES FOR CRANES," which is incorporated, in its entirety, by this reference.

BACKGROUND

The present application relates to counterweight blocks and associated assemblies; mobile lift cranes using the counterweight blocks to provide counterweight to its loads; and methods of making and utilizing the counterweight blocks and associated assemblies.

Mobile lift cranes such as the one referred to herein are very heavy and must be broken down into pieces for transportation between job sites, wherein the weight of each piece that is transported must be within highway transportation weight limits. The allowable weight limit of each piece may vary in some countries, and may also vary based on the weight of the transportation vehicles. Accordingly, it is necessary to build the crane in a modular way, keeping each piece within at least the weight limits of the largest transportable load.

In the United States, the maximum weight that may be placed on a trailer for long haul transportation, without a special permit, is 44,000 pounds, or 20 metric tonne. Typical counterweight blocks each weigh 10 metric tonne. While the counterweight blocks could be transported in a stacked configuration on a flat bed, typically two counterweight blocks are placed one over each axel of the flat bed to spread the load out. Some countries also have maximum width limitations. In addition to transportability, customer needs, and supplier or foundry availability affect design of counterweight blocks, which are typically cast or built in weights of 5, 10, or 20 metric tonne.

A crane at a job site lifts very heavy loads, and therefore, requires a substantial number of the counterweight blocks on a counterweight tray of the crane to provide a counterweight for lifting those loads. The heavier the load, the more counterweight blocks that are needed on the counterweight tray, which means that the counterweight blocks are often stacked together. Since some cranes use hundreds of metric tonne of counterweight blocks, it can take a long time to transport and stack the counterweight blocks at the job site. Additionally, it can be difficult to keep higher stacks of counterweight blocks secured to prevent them from tipping while the crane is in operation, especially if the stack is moveable with respect to the rest of a rotating bed of the crane.

DETAILED DESCRIPTION OF THE DRAWINGS AND THE PRESENTLY PREFERRED EMBODIMENTS

Figure 1:
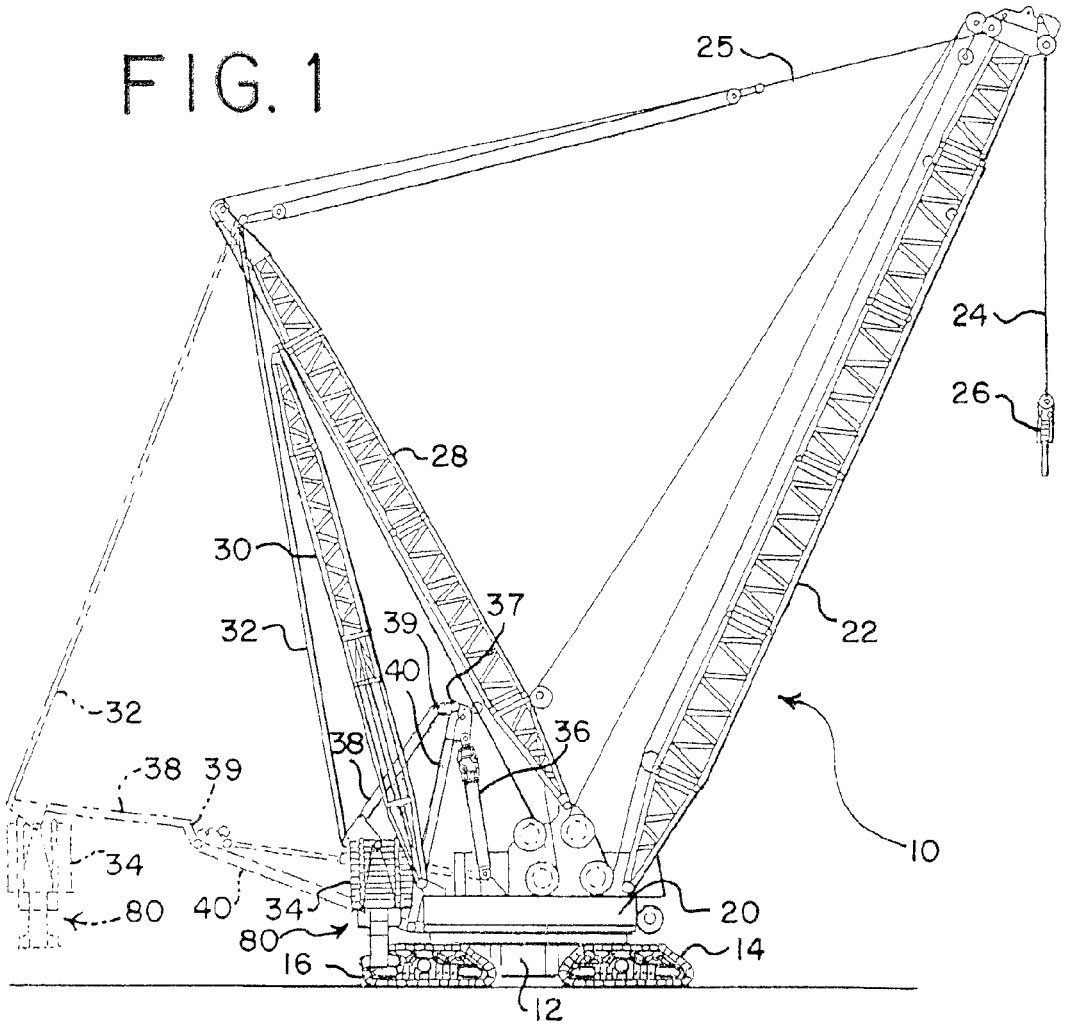
FIG. 1 is a side elevational view of a mobile lift crane with counterweight blocks according to the present disclosure.

The present embodiments will now be further described. In the following passages, different aspects of the embodiments are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The preferred embodiment of the present embodiments relates to a high capacity mobile lift crane, other aspects of which are disclosed in U.S. Pat. No. 7,546,928 and the following co-pending United States patent applications assigned to the assignee of the present application: "Mobile Lift Crane With Variable Position Counterweight," Ser. No. 12/023,902, filed Jan. 31, 2008, "Mast Raising Structure And Process For High-Capacity Mobile Lift Crane," Ser. No. 11/740,726, filed Apr. 26, 2007, "Connection System For Crane Boom Segments," Ser. No. 12/273,310, filed Nov. 18, 2008, "Drive Tumbler And Track Drive For Mobile Vehicles, Including Lift Cranes," Ser. No. 12/368,143, filed Feb. 9, 2009, "Track Connection System For Mobile Vehicles, Including Lift Cranes," Ser. No. 12/368,125, filed Feb. 9, 2009, "Track Tensioning System For Mobile Vehicles, Including Lift Cranes," Ser. No. 12/368,113, filed Feb. 9, 2009, "Boom Hoist Transportation System And Crane Using Same," Ser. No. 12/561,007, filed Sep. 16, 2009, Carbody Connection System And Crane Using Same," Ser. No. 12/561,103, filed Sep. 16, 2009, "Trunnion Transportation System And Crane Using Same," Ser. No. 12/561,058, filed Sep. 16, 2009, "Drum Frame System For Cranes," Ser. No. 12/561,094, filed Sep. 16, 2009, Swing Drive System For Cranes," Ser. No. 12/710,960, filed Feb. 23, 2010, "Crane Hook Block," Ser. No. 12/709,678, filed Feb. 22, 2010, "Folding Jib Main Strut And Transportable Reeved Strut Caps," Ser. No. 61/165,403, filed Mar. 31, 2009, "Crane Boom Stop," Ser. No. 61/179,935, filed May 20, 2009, and "Crane Backstay Spreader," Ser. No. 61/179,983, filed May 20, 2009. Each of these applications is hereby incorporated by reference.

While the embodiments of the counterweight blocks and associated assemblies will have applicability to counterweight blocks used on other cranes or machinery, it will be described in connection with a mobile lift crane 10, shown in FIGS. 1-2. The mobile lift crane 10 includes lower works, also referred to as a carbody 12, and moveable ground engaging members in the form of crawlers 14 and 16. There are two front crawlers 14 and two rear crawlers 16, only one each of which can be seen from the side view of FIG. 1. The other set of crawlers can be seen in the perspective view of FIG. 2. In the crane 10, the ground engaging members could be just one set of crawlers, one crawler on each side.

A rotating bed 20 is rotatably connected to the carbody 12 such that the rotating bed can swing with respect to the ground engaging members. The rotating bed is mounted to the carbody 12 with a slewing ring, such that the rotating bed 20 can swing about an axis with respect to the ground engaging members 14, 16. The rotating bed supports a boom 22 pivotally mounted on a front portion of the rotating bed; a mast 28 mounted at its first end on the rotating bed; a backhitch 30 connected between the mast and a rear portion of the rotating bed; and a moveable counterweight unit 34, which include stacks 84 of individual counterweight blocks 100 on a support member 33, sometimes also referred to herein as a counterweight tray 33. (FIG. 2 is simplified for sake of clarity, and does not show the full lengths of the boom, mast, and backhitch.)

Boom hoist rigging 25 between the top of mast 28 and boom 22 is used to control the boom angle and transfers load so that the counterweight can be used to balance a load lifted by the crane. A load hoist line 24 extends from the boom 22, supporting a hook 26. The rotating bed 20 may also include other elements commonly found on a mobile lift crane, such as an operator's cab and hoist drums for the rigging 25 and load hoist line 24. If desired, the boom 22 may include a luffing jib pivotally mounted to the top of the main boom, or other boom configurations. The backhitch 30 is connected adjacent the top of the mast 28, but down the mast far enough that it does not interfere with other items connected to the mast. The backhitch 30 may comprise a lattice member designed to carry both compression and tension loads as shown in FIG. 1. In the crane 10, the mast is held at a fixed angle with respect to the rotating bed during crane operations, such as a pick, move and set operation.

The counterweight unit 34 is moveable with respect to the rest of the rotating bed 20. A tension member 32 connected adjacent the top of the mast supports the counterweight unit in a suspended mode. A counterweight movement structure is connected between the rotating bed 20 and the counterweight unit 34 such that the counterweight unit 34 may be moved to and held at a first position in front of the top of the mast, and moved to and held at a second position rearward of the top of the mast.

At least one linear actuation device, in this embodiment a rack and pinion assembly 36, and at least one arm pivotally connected at a first end to the rotating bed and at a second end to the a rack and pinion assembly 36, are used in the counterweight movement structure of crane 10 to change the position of the counterweight unit 34. The arm and a rack and pinion assembly 36 are connected between the rotating bed and the counterweight unit 34 such that extension and retraction of the rack and pinion assembly 36 changes the position of the counterweight unit 34 compared to the rotating bed 20. While FIG. 1 shows the counterweight unit 34 in its most forward position in solid lines and at its farthest back position in dotted lines, FIG. 2 shows the rack and pinion assembly 36 partially extended, which moves the counterweight unit 34 to a mid position, such as when a load is suspended from the hook 26.

The pivot frame 40, a solid welded plate structure, is connected between the rotating bed 20 and the second end of the rack and pinion assembly 36. The rear arm 38 is connected between the pivot frame 40 and the counterweight unit 34. A set of pins 37 are used to connect the rear arm 38 and the pivot frame 40. The rear arm 38 is also a welded plate structure with an angled portion 39 at the end that connects to the pivot frame 40. This allows the arm 38 to connect directly in line with the pivot frame 40.

The crane 10 is equipped with a counterweight support system 80, which may be required to comply with crane regulations in some countries. The counterweight support system 80 includes at least two ground engaging members in the form of support feet 82 that can provide support to the counterweight in the event of a sudden release of the load. However, during normal crane operations, including pick, move, and set maneuvers, the support feet 82 are never in contact with the ground.

Because the counterweight unit 34 can move far forward with respect to the front of the rotating bed, the support feet 82 on the support system 80 may interfere with swing operations unless they are sufficiently spaced apart. This, however, makes the support structure itself very wide. The crane 10 thus uses a telescoping counterweight support system 80 that includes a telescoping structure 83 connected to and between the support feet 82 such that the distance between the support feet 82 can be adjusted.

The counterweight unit 34 is constructed so that the counterweight support system 80 can be removed and the crane can function both with and without it. The counterweight movement and support structures are more fully disclosed in U.S. patent application Ser. No. 12/023,902, entitled "Mobile Lift Crane With Variable Position Counterweight," filed Jan. 31, 2008, published as US 2008-0203045 A1.

Figure 2:
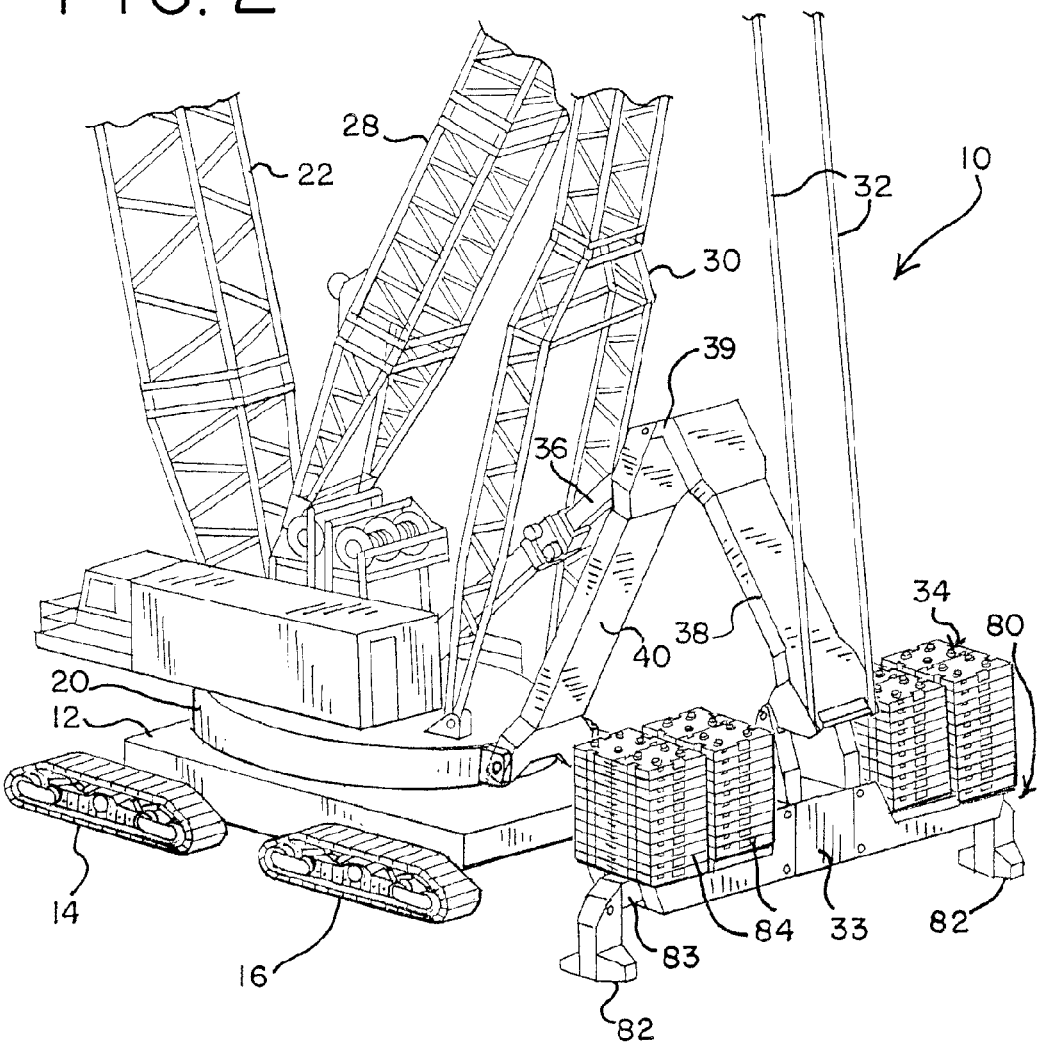
FIG. 2 is a rear perspective view of the crane of FIG. 1.
Figure 3:
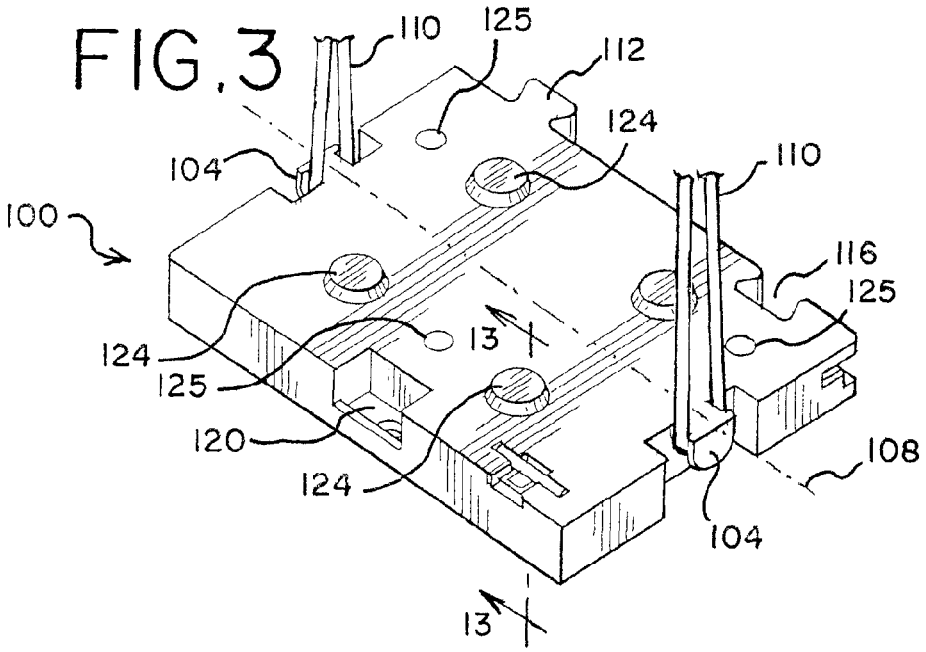
FIG. 3 is a top perspective view of a counterweight block usable on the crane of FIGS. 1 and 2 and which may be lifted at a pair of lifting lugs.

FIG. 3 is a top perspective view of a counterweight block 100—sometimes referred to herein as a block 100—usable for the counterweight stacks 84 by the crane 10 of FIGS. 1 and 2. The counterweight block 100 may be lifted at a pair of lifting lugs 104. A dashed line 108 indicates the location of a vertical plane drawn through the center of gravity of the counterweight block 100 that intersects both lifting lugs 104. Having balanced both sides of the counterweight block 100 about the dashed line 108, it may be lifted by an assist crane, for instance, at the two lifting lugs 104. A strap 110 or other securement line of the assist crane may be secured around each lifting lug 104 to facilitate lifting the counterweight block 100.

Figure 4:
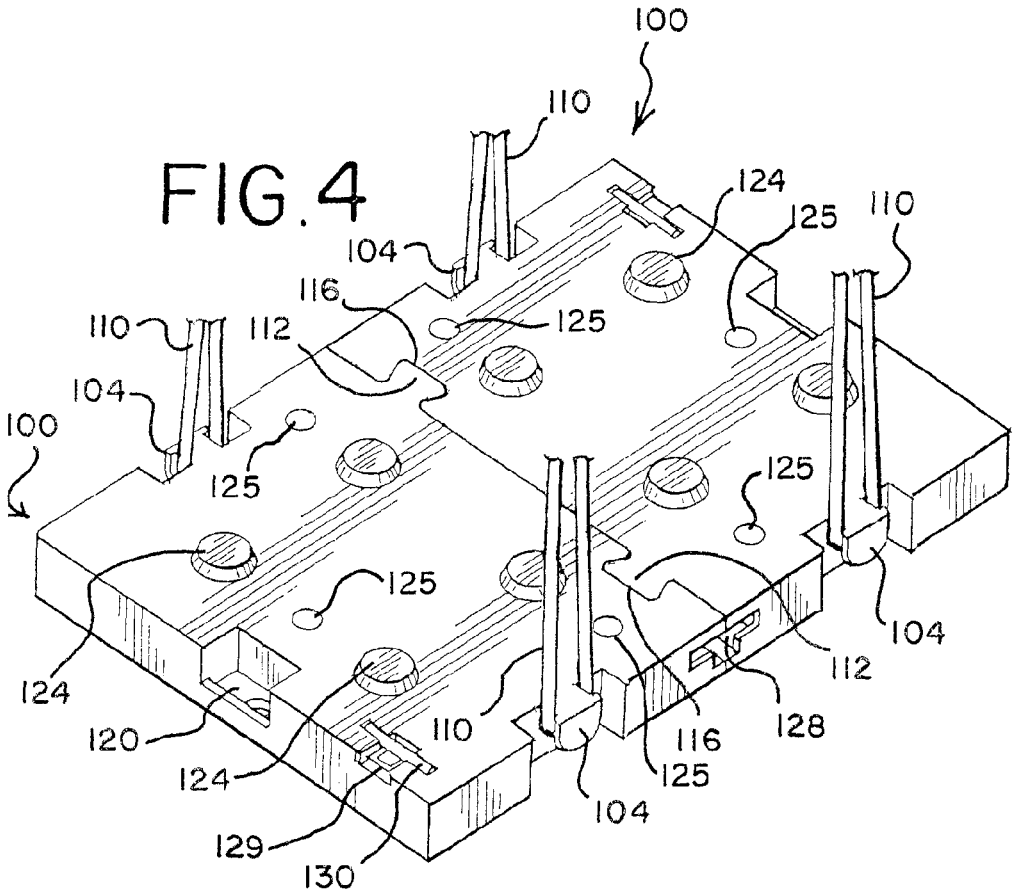
FIG. 4 is a top perspective view of two interlocking counterweight blocks of FIG. 3, the two blocks being liftable at the four lifting lugs.

The counterweight block 100 includes a male interlocking piece 112 and a female interlocking space 116 which, as seen in FIG. 4, provides for interlocking connection between two counterweight blocks arranged side by side. Other types of structures may be used to interlock the two blocks, so the types of interlocking pieces 112 and spaces 116 displayed are but exemplary. The counterweight block 100 may also include an indentation 120, which may be used for climbing up a stack of counterweight blocks, which will be discussed in more detail below.

Furthermore, the counterweight block 100 may include multiple protrusions 124 on a top thereof and corresponding recesses (not shown) on a bottom thereof for receipt of the protrusions 124 of another counterweight block 100 when stacked thereon. Displayed are four protrusions 124 on a block, but other embodiments are envisioned including two, three, five, six, eight, etc., protrusions 124 on the top of the block. Advantageously, a matching number and location of recesses on the bottom of the block 100 would be included in these other embodiments. In still further embodiments, the bottom of each block may include more recesses than there are protrusions 124. While protrusions 124 are for side-to-side alignment, use of additional recesses—more than the number of protrusions 124 in the bottom of each block—allows blocks stacked on top of two other blocks to span cross the lower blocks in varying arrangements.

Each counterweight block 100 may also include a plurality of, preferably three, raised bumps 125, which are designed to come into planar contact with the flat surface of the bottom of a block 100 being stacked on top thereof. The raised bumps may be circular or of some other shape. The recesses in the bottom of each block 100 may be deeper than the protrusions 124 are thick, so that the bumps 125 provide the only contact between the top and bottom surfaces of stacked blocks 100. Because three raised bumps 125 are used, as shown in FIG. 3, a plane of contact is formed at contact points of the raised bumps 125. Because the preferred blocks are formed using a casting operation, in which there is likely to be some warpage as the blocks cool, it is difficult to get the top and bottom surfaces of the blocks completely planar. Like a three-legged stool, the three contact points assure that the block on top will still sit in a stable position and not rock even though the top and bottom surfaces may be uneven. Also, the blocks 100 will have a small gap in between them when stacked, the gap equal to the height of the bumps 125. This provides an aesthetic appearance to the stack of blocks. More than three raised bumps 125 may of course be used in different configurations depending on the size of the counterweight blocks 100 and relative location of the raised bumps 125.

FIG. 4 is a top perspective view of two interlocking counterweight blocks 100 such as of the one displayed in FIG. 2, the two blocks being liftable at the four lifting lugs 104 by the strap 110. In FIG. 4, interlocking male pieces 112 and female spaces 116 are engaged such as to prevent substantial lateral movement along a width or length of the interlocked blocks 100. Multiple sets of interlocking counterweight blocks 100 may be stacked in this fashion to build a stack 84 of counterweight blocks 100 during assembly of the counterweight unit 34 of the crane 10.

Furthermore, a portion of a cavity may be formed within a side of each block 100 at a corner. Each cavity portion may correspond to the cavity portion of the other block so as to be combined into a single longitudinal cavity 128 when the blocks 100 are interlocked side by side. An additional (or storage) cavity 129, substantially matching the shape of the longitudinal cavity 128, may be formed in a top of the counterweight blocks 100. A shear bar 130 may be inserted in the longitudinal cavity 128 for reasons discussed with reference to FIG. 6, or in the storage cavity 129 when being stored.

Figure 5:
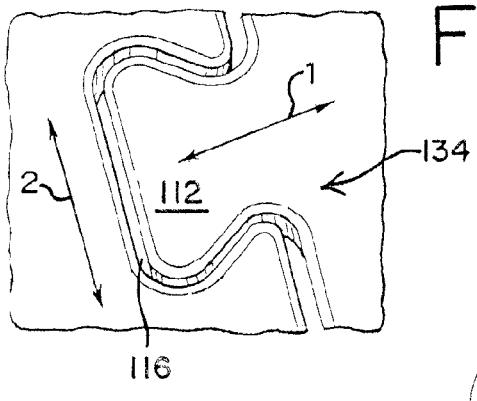
FIG. 5 is a top perspective view of an interlocking connection between two counterweight blocks of FIG. 3.

FIG. 5 is a top perspective view of an interlocking connection 134 between two counterweight blocks 100. As discussed above, the male interlocking piece 112 may fit inside of the female interlocking space 116 to provide resistance to relative movement of the two blocks 100 in either of the first or second directions displayed by arrows 1 and 2, respectively. The first and second directions correspond to the width and length of the counterweight block, not necessarily in that order. Other structures or other shapes of the same interlocking pieces may be employed; accordingly, the interlocking nature of the connection 134 is not limited to the embodiment displayed.

Figure 6:
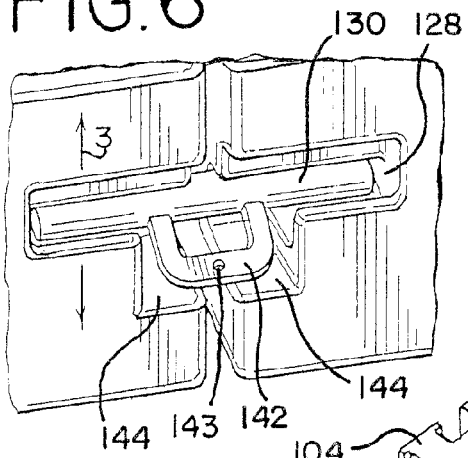
FIG. 6 is a side perspective view of a shear bar inserted in a cavity formed between two interconnected counterweight blocks of FIG. 3 to provide resistance to relative vertical movement between the two blocks.

FIG. 6 is a side perspective view of the shear bar 130 inserted in the cavity 128 formed between two interconnected counterweight blocks 100 to provide resistance to relative vertical movement between the two blocks when being lifted together. Vertical in this case refers to a direction along a plane generally perpendicular to a longitudinal axis of the shear bar 130, or in other words, a third orthogonal direction different from those displayed by arrows 1 and 2 in FIG. 5. The third direction is displayed by arrow 3 in FIG. 6.

The shear bar 130 may include an anti-rotational feature, which may include forming the shear bar with one or more flat sides, such as making it rectangular in shape. The anti-rotational feature may also include a side extension member, such as a handle 142, which resists rotational movement of the shear bar 130 within the longitudinal cavity 128. Resisting rotational movement substantially prevents the shear bar 130 from taking on rotational momentum during movement of an interlocked pair of blocks 100, to resist dislodgement of the shear bar 130 from the longitudinal cavity 128. The handle 142 also facilitates insertion and removal of the shear bar 130 from the cavity 128. The cavity 128 may further include an additional cavity 144 extended therefrom for receipt of the handle 142 so that the handle 142 does not protrude from the side of the block 100. The handle 142 may also include a hole 143 therethrough for reception of a stud 170 and retaining pin, discussed below with reference to FIG. 13.

While not displayed, a pair of brackets, one on each counterweight block 100, may also be used in lieu of the cavity 128. Accordingly, the shear bar 130 could be spanned between the outside of the intersection of the two blocks 100 and the brackets (or some other structure) could be used to retain the shear bar 130 in place.

Figure 7:
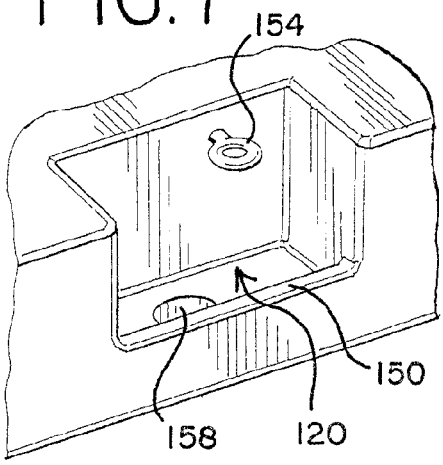
FIG. 7 is a side perspective view of an indentation formed in a side of a counterweight block of FIG. 3, the indentation usable for climbing when multiple counterweight blocks are stacked.

FIG. 7 is a side perspective view of the indentation 120 formed in a side of a counterweight block 100, the indentation usable for climbing when multiple counterweight blocks are stacked. In FIG. 7, the indentation 120 is created from the top of the block 100 down to a depth shallower than the thickness of the counterweight block 100. This indentation 120 is box-like and has a flat bottom, but other indentations could be formed having curved sides or various shapes. The indentation 120 also need not be located precisely as shown and could be created in varying locations along the thickness of the block so that a number of the indentations 120 are sequentially created within a stack of blocks (84 in FIG. 11). The indentation 120 is preferably formed with a lip 150, which may be used as a hand hold when climbing up a stack of blocks 100. The lip 150 may be created in different ways, for instance, by adding an attachment such as a bar across the indentation 120.

Figure 11:
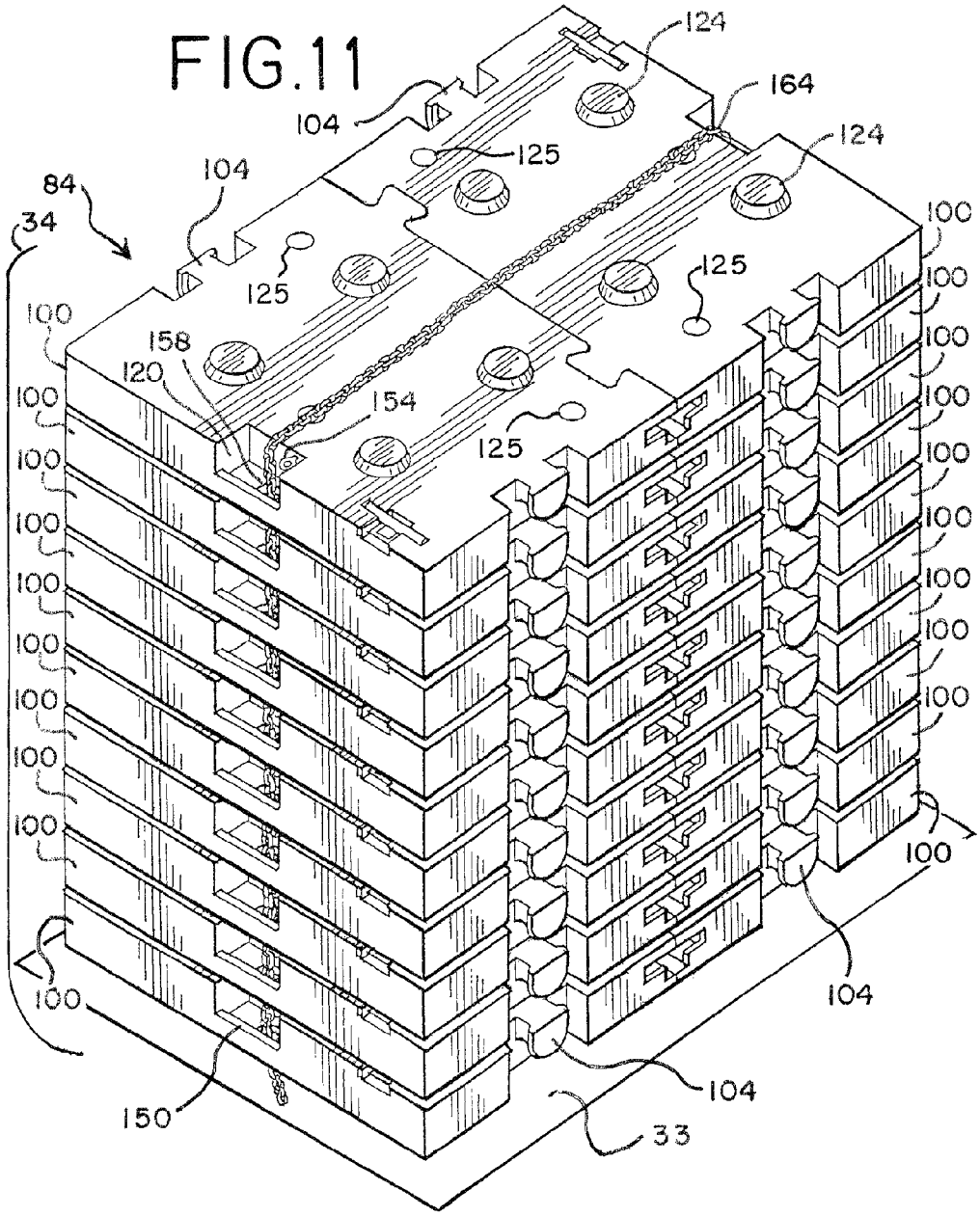
FIG. 11 is perspective view of a stack of counterweight blocks of FIG. 3, secured to a counterweight tray by a chain.

A ring 154 may be attached to a portion of the indentation, e.g., to the indentation wall, to be used as a personal protection tie-off point for a worker climbing up a stack 84 of blocks 100 such as that displayed in FIG. 11. An aperture 158 is formed in a bottom of the indentation through which a retaining strap such as a chain may be fed when securing together a stack 84 of blocks 100. The aperture 158 also provides a location for water to drain out of the indentation 120. This aperture 158 may be formed in another location of the counterweight block 100, for instance, through the entire thickness thereof. Having shallower apertures 158, however, may be easier to form and through which to thread a retaining strap.

Figure 8:
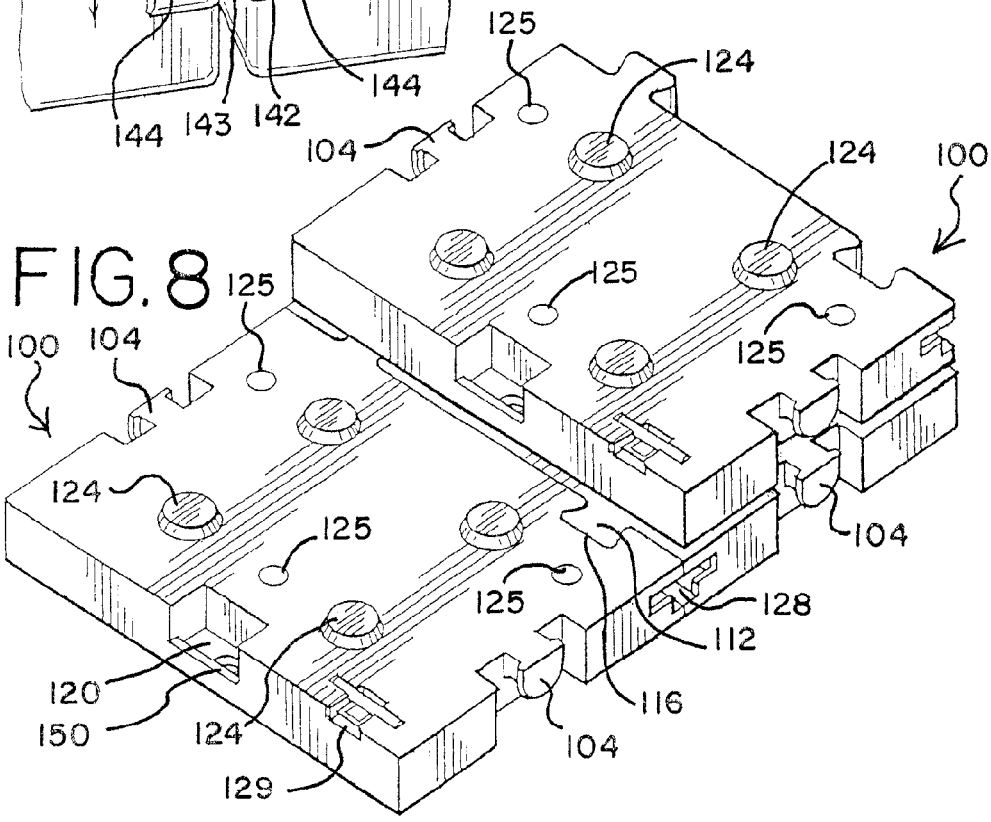
FIG. 8 is a top perspective view of a first manner of stacking three counterweight blocks of FIG. 3.
Figure 9:
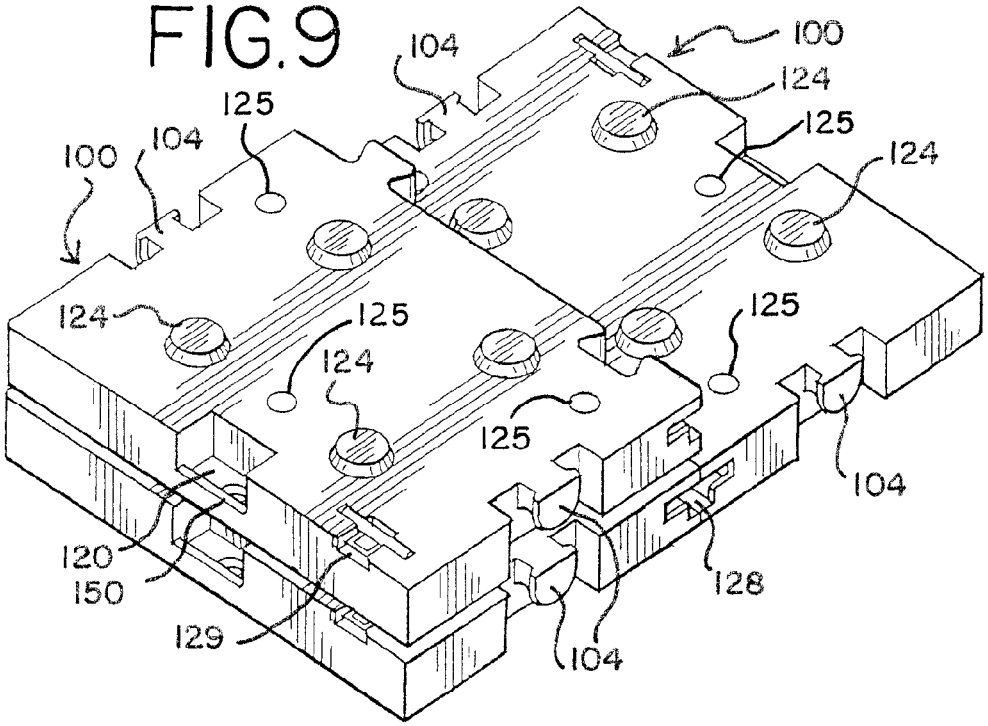
FIG. 9 is a top perspective view of another manner of stacking three counterweight blocks of FIG. 3.

FIG. 8 is a top perspective view of a manner of stacking three counterweight blocks 100. FIG. 9 is a top perspective view of another manner of stacking three counterweight blocks 100. A pair of blocks 100 can be interlocked side by side, as displayed in FIG. 4, although they need not be. Likewise one or more additional counterweight blocks may be placed directly on top of a bottom counterweight block that is interlocked with or sitting next to another counterweight block, as displayed in FIGS. 8 and 9. The protrusions 124 of the bottom block 100 are insertable into corresponding recesses of a top block 100. Furthermore, while not shown, a pair of stacked counterweight blocks 100 may be simultaneously lifted while stacked together, and lowered so that male interlocking pieces 112 slide within the female interlocking spaces 116 of two other, stacked counterweight blocks, forming interconnecting connections 134 therewith.

Figure 10:
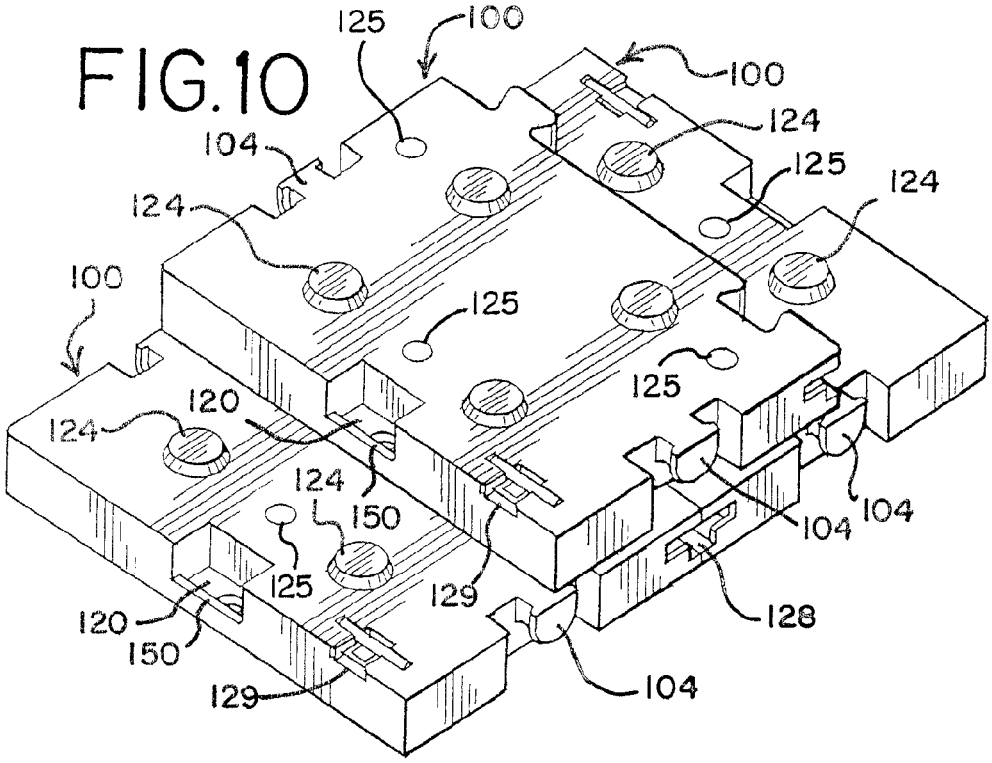
FIG. 10 is a top perspective view of yet another manner of stacking three counterweight blocks of FIG. 3.

FIG. 10 is a top perspective view of yet another manner of stacking three counterweight blocks 100. In this embodiment, a counterweight block 100 may be straddled on top of two other blocks 100, the recesses of the top block receiving a portion of the protrusions 124 of each bottom block. In this embodiment, the number of protrusions 124 received from each bottom block is two, but this number could vary depending on a number of protrusions formed in different embodiments of each counterweight block 100. As before, the bottom two blocks 100 need not be interlocked, although they may be somehow interconnected or at least sitting side by side.

FIG. 11 is perspective view of a stack 84 of counterweight blocks 100, which is secured by a retaining strap (or chain) 164 to the counterweight tray 33 to produce the counterweight unit 34 such as that shown in FIGS. 1 and 2. The manner of stacking the counterweight blocks 100 discussed above may be employed. The retaining strap (or chain) 164 may then be threaded through a plurality of apertures 158, as discussed above. The retaining strap 164 may then be secured or attached to the counterweight tray 33. Accordingly, the counterweight blocks 100 will be more secure when stacked as the counterweight unit 34, for instance when the crane 10 is lifting a load or the counterweight unit 34 is being moved.

Figure 12:
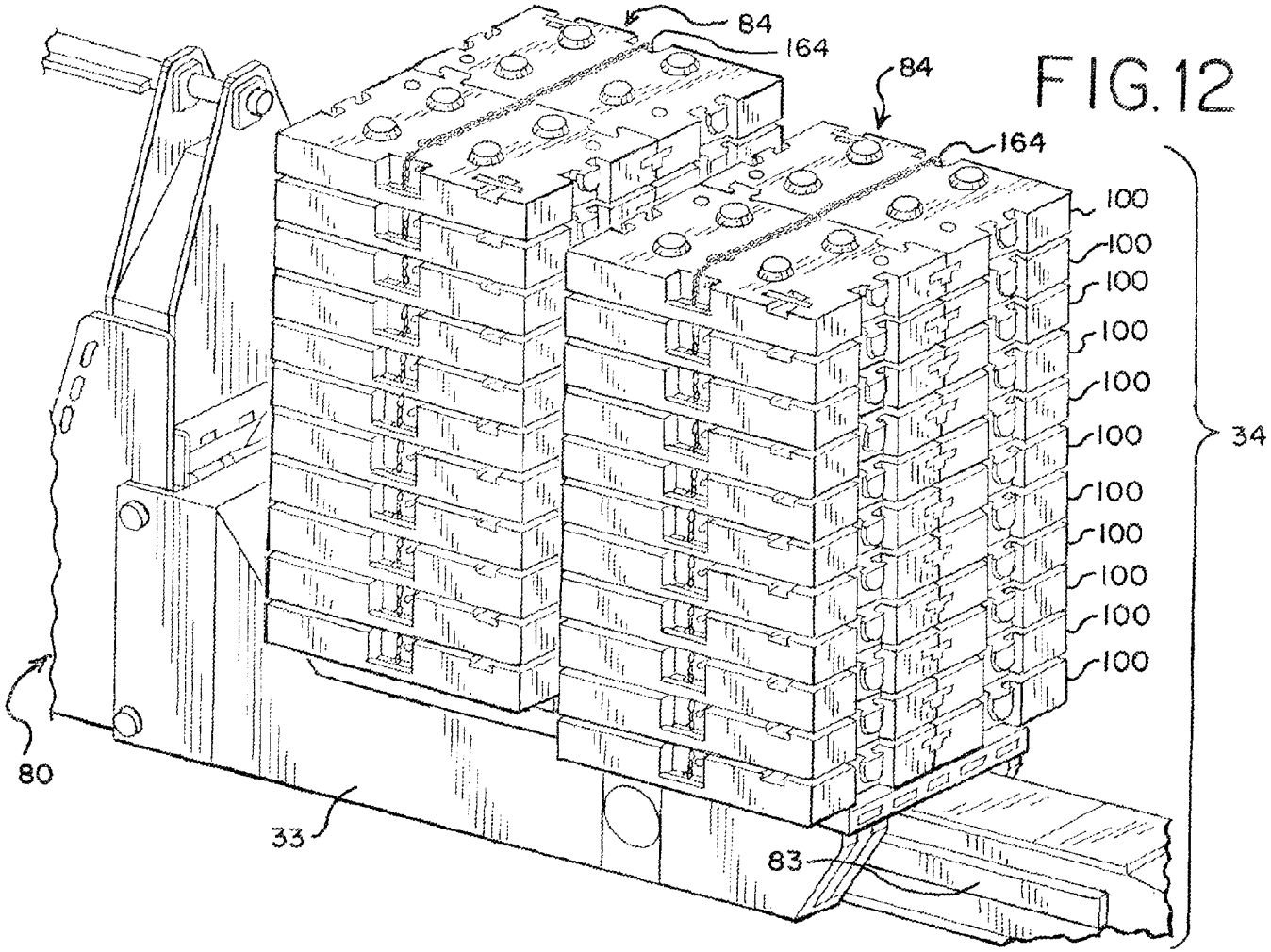
FIG. 12 is a side perspective view of two stacks of counterweight blocks of FIG. 11, on a counterweight tray.

FIG. 12 is a side perspective view of two stacks 84 of counterweight blocks 100 as in FIG. 11, on the counterweight tray 33. As shown in FIG. 12, the counterweight tray 33 may be narrower than the stack 84 of counterweight blocks 100. The width of the counterweight tray 33 is limited due to transportation size constraints. Accordingly, stacking the counterweight blocks independently, side by side, previously created a center of gravity close to the edge of the tray 33, making each stack insufficiently stable, especially in light of the fact that each stack of blocks overhangs the tray 33. By placing the blocks side by side and interlocking the counterweight blocks 100 as shown, the center of gravity of the combined blocks is centralized over the narrow counterweight tray 33, allowing the counterweight blocks 100 to be stacked in twos, side by side, without concern of tipping over the side of the tray 33. The shear bar 130, if employed in each set of interlocked counterweight blocks 100, likewise helps to keep any vertical shear forces from causing the stack 84 to tip toward a side of the counterweight tray 33, increasing stability of the stack 84 blocks. Similarly, the retaining strap (or chain) 164 may be used to secure one or more of the stacks 84 to the counterweight tray 33.

Furthermore, the counterweight blocks 100 configured as described above may be stacked in single stacks of blocks 100—not interconnected stacks of blocks—on different crane models having shorter trays 33 that can only fit a single stack of blocks. Likewise, the ability to separate the blocks 100 may be beneficial for different configurations in transport to maximize the carrying capacity of trailers without overloading them.

Figure 13:
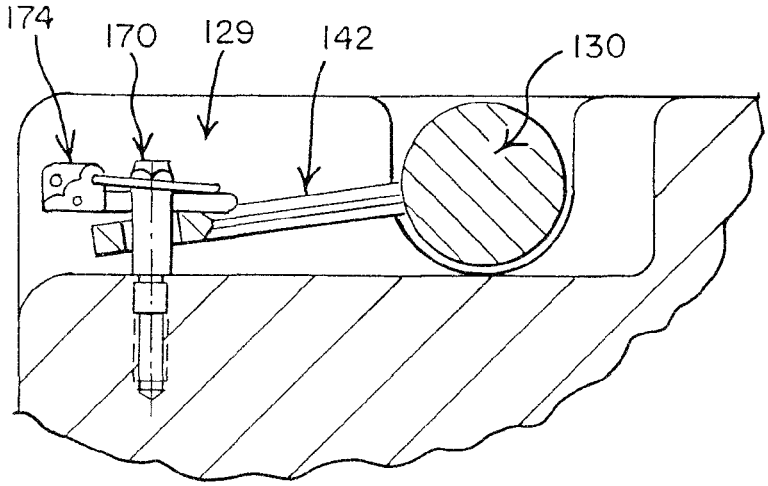
FIG. 13 is a cross-section view of a linchpin assembly taken along line 13-13 of the counterweight block of FIG. 3, the linchpin assembly for securing the shear bar within a storage cavity of the counterweight block.

In FIG. 13, the shear bar 130 and handle 142 are shown in a cross-section view when stored in the storage cavity 129. A stud 170 may be set in a drilled hole or otherwise secured within a bottom surface of the storage cavity 129. As discussed with reference to FIG. 6, the handle 142 may include a hole 143 through which the free end of the stud 170 may pass. The free end of the stud 170 also includes an aperture through which a linchpin 174 may be inserted to secure the handle 142 to the bottom of the storage cavity 129, thus preventing the shear bar 130 from being shaken lose during transport when not being used to interlock two blocks 100 together.

The preferred embodiments of the present invention provide numerous advantages. Because the counterweight blocks 100 may be built in various sizes, they may be advantageously transported to a job site up to an amount of weight required by the crane 10 on that site. Furthermore, together with the lifting lugs 104 located along the center of gravity of the counterweight blocks 100, the interlocking connection 134 allows two blocks 100 to be lifted simultaneously, side by side, for quicker stacking, thus enabling quicker setup of the crane 10 at the job site. The interlocking connection 134 also allows the center of gravity of two interconnected blocks 100 to be located along the interconnected sides, preventing tipping over of stacks 84 of blocks 100 located next to each other on a the narrow counterweight tray 33. The shear bar 130 provides resistance to relative vertical movement of the two interconnected counterweight blocks 100 while lifting, when stacked, and when being moved while on the tray 33 during operation of the crane 10. The indentations 120 formed in the side of each counterweight block 100, together with the lip 150, facilitate climbing up and down the stack 84 of counterweight blocks, which may be required to thread the securing strap 164 to a stack 84 of counterweight blocks 100, among other reasons.

It should be understood that various changes and modifications to the presently preferred embodiments described herein will be apparent to those skilled in the art. For example, four or more lifting lugs or other structure to facilitate lifting the heavy counterweight block may be used. The lifting lugs may vary in size and shape. Varying the number, size, or shape of protrusions and recesses may be employed on each counterweight block, so long as they are stackable. Varying structures may be used to allow interlocking blocks side by side. Also, apertures through which the retaining strap may be threaded may be located elsewhere on the counterweight blocks. Furthermore, the interlocked counterweight blocks stackable as in FIG. 11 may be stacked elsewhere or used in a different setting than on a counterweight tray of a crane. Such changes and modifications can be made without departing from the spirit and scope of the present embodiments and without diminishing its intended advantages. It is therefore intended that such changes and modifications be covered by the appended claims.

The invention claimed is:

1. A counterweight block apparatus comprising:

a) a pair of interconnecting counterweight blocks, each counterweight block having a top and a bottom surface, a first side, two opposing second sides located externally to the counterweight blocks, a lifting lug on one of the second sides and another lifting lug on the other of the second sides, the counterweight blocks being interlocking directly to each other along adjacent first sides thereof, and the first and second sides being narrower than the top and bottom surfaces; and b) a shear bar configured to be releasably secured between the adjacent first sides of the interconnecting counterweight blocks, generally perpendicular to the plane of interconnection, the shear bar being configured to provide resistance to relative vertical movement of the interconnecting counterweight blocks along the plane of interconnection when the interconnecting counterweight blocks are lifted via the lifting lug and the another lifting lug on each counterweight block;

wherein each of the interconnecting counterweight blocks includes a longitudinal cavity in at least one of the second sides thereof, wherein the longitudinal cavities coincide to form a single, longitudinal cavity between the interconnecting counterweight blocks depressed within a surface of the at least one of the second sides; and, wherein the shear bar is inserted within the single longitudinal cavity.

2. The counterweight block apparatus of claim 1, wherein each counterweight block includes a female connector and a male connector, the male connector to fit within the female connector of another counterweight block.

3. The apparatus of claim 1, wherein the shear bar includes an anti-rotational feature selected from the group consisting of a side extension member and a geometry of the shear bar that includes one or more flat sides, the anti-rotational feature to resist rotational movement of the shear bar within the single longitudinal cavity.

4. The apparatus of claim 3, wherein the shear bar includes a side extension member comprising a handle to facilitate placement and removal thereof within the single longitudinal cavity, and wherein the longitudinal cavities further define an additional depression for receipt of the handle.

5. An interlocked pair of counterweight blocks, comprising:

a) a first and a second substantially identical counterweight block each having (i) a top and bottom; (ii) two opposing sides; and (iii) a third side, and two lift lugs substantially in a center of the two opposing sides of the counterweight block, wherein a vertical plane drawn through a center of gravity of each respective counterweight block intersects both lifting lugs such that each respective counterweight block can be lifted at only the two lifting lugs;

b) wherein each of the first and second counterweight blocks include interlocking pieces in the third side for interconnecting the first and second counterweight blocks side by side such that the interlocked combination of the first and second counterweight blocks can be lifted by the four lifting lugs;

c) a longitudinal cavity in one of the opposing sides of each of the first and second counterweight blocks, wherein the longitudinal cavities coincide to form a single, longitudinal cavity between the interconnecting first and second counterweight blocks; and d)a shear bar, an entirety of which is removably located within the single longitudinal cavity, configured to provide resistance to relative vertical movement of the interconnected first and second counterweight blocks along a plane perpendicular to a longitudinal axis of the shear bar when the interlocked pair of counterweight blocks are lifted via the two lifting lugs on each counterweight block.

6. A crane with a counterweight tray having a stack of interlocked pairs of counterweight blocks according to claim 5, wherein the counterweight blocks are stacked on the counterweight tray such that the interconnected third sides of each counterweight block are positioned over the counterweight tray, wherein the sides opposite the interconnected third sides hang over the edge of the counterweight tray.

7. The interlocked pair of counterweight blocks of claim 5, wherein the interlocking pieces comprise a female connector and a male connector, the male connector to fit within the female connector of another counterweight block.

8. The interlocked pair of counterweight blocks of claim 5, wherein the two lifting lugs are recessed into the two opposing sides thereof.

9. A method of stacking counterweight blocks, comprising:

a) providing a first and a second substantially identical counterweight block each having (i) a top and a bottom; (ii) two opposing sides; (iii) a third side; and two lifting lugs substantially in a center of the two opposing sides of the counterweight block, wherein a vertical plane drawn through a center of gravity of each respective counterweight block intersects both lifting lugs such that each respective counterweight block can be lifted at only the two lifting lugs; a longitudinal cavity in one of the opposing sides of each of the first and second counterweight blocks, wherein the longitudinal cavities coincide to form a single, longitudinal cavity between the first and second counterweight blocks;

b) interlocking the first and second counterweight blocks together with interlocking pieces that mate together along the third sides of the first and second counterweight blocks;

c) inserting a shear bar within the single longitudinal cavity;

d) lifting the interconnected first and second counterweight blocks at the four lifting lugs, wherein the shear bar resists relative vertical movement of the first and second counterweight blocks along a plane perpendicular to a longitudinal axis of the shear bar;

e) setting the interconnected first and second counterweight blocks at a stacking location; and f) repeating steps (a) through (e) to build a stack of interconnected counterweight blocks.

10. The method of claim 9, wherein the interlocking pieces comprise a female connector and a male connector, the male connector to fit within the female connector of another counterweight block.

* * * * *